United States Patent [19]

Chen et al.

[11] 4,411,770

[45] Oct. 25, 1983

[54] HYDROVISBREAKING PROCESS

[75] Inventors: Nai Y. Chen, Titusville; Eric J. Scott, Princeton; David S. Shihabi, Pennington, all of N.J.

[73] Assignee: Mobil Oil Corporation, New York, N.Y.

[21] Appl. No.: 369,330

[22] Filed: Apr. 16, 1982

[51] Int. Cl.[3] ..... C10G 47/20

[52] U.S. Cl. ..... 208/111; 208/89; 208/213; 208/251 H; 208/254 H

[58] Field of Search ..... 208/89, 111

[56] References Cited

U.S. PATENT DOCUMENTS 3,905,893 9/1975 Christman et al. ..... 208/58 X
3,985,643 10/1976 Milstein ..... 208/210
4,263,129 4/1981 Chen et al. ..... 208/111
4,313,817 2/1982 Mayer et al. ..... 208/89

*Primary Examiner*—Delbert E. Gantz
*Assistant Examiner*—G. E. Schmitkons
*Attorney, Agent, or Firm*—Michael G. Gilman; Charles J. Speciale

[57] ABSTRACT

This invention provides an improved process for hydroconversion of a heavy hydrocarbon oil having a CCR content of 8–30 weight percent, which process involves contacting the heavy oil in a hydrovisbreaking zone containing a low acidity zeolite catalyst and recovering and fractionating the visbroken effluent to provide distillate products and a 1000° F.+ fraction which has a Kinematic Viscosity between about 30,000–60,000 centistokes at 100° F.

10 Claims, No Drawings

HYDROVISBREAKING PROCESS

BACKGROUND OF THE INVENTION

The economic and environmental factors relating to upgrading of petroleum residual oils and other heavy hydrocarbon feedstocks have encouraged efforts to provide improved processing technology, as exemplified by the disclosures of various U.S. patents which include U.S. Pat. Nos. 3,696,027; 3,730,879; 3,775,303; 3,876,530; 3,882,049; 3,897,329; 3,905,893; 3,901,792; 3,964,995; 3,985,643; 4,016,067; 4,263,129; and the like.

Visbreaking is a mild cracking operation employed to reduce the viscosity of heavy residua. The heavy residua are sometimes blended with valuable lighter oil, or cutter stocks, to produce fuel oils of acceptable viscosity. By use of visbreakers, the viscosity of the heavy residua is reduced so as to reduce the requirement of the cutter stock. The ultimate objective of the visbreaking operation is to completely eliminate the need for cutter stocks.

Sometimes visbreakers are also used to generate more gas oils for catalytic cracking and naphtha for reforming to increase the gasoline yield in the overall refining operation. To achieve these goals, the visbreaker has to be operated at high enough severity to generate sufficient quantities of lighter products.

If visbreaking of heavy hydrocarbon oil is conducted in the presence of an acidic catalyst such as HZSM-5, there is some disadvantage as to the quantity of $C_1$–$C_3$ hydrocarbons produced, and the catalyst tends to experience deactivation in the presence of metals and sulfur.

If visbreaking of heavy hydrocarbon oil is conducted in the presence of a low acidity catalyst such as NaZSM-5, the said catalyst exhibits excellent stability and ageing properties as described in U.S. Pat. No. 4,263,129. However, the residual 1000° F.+ fraction of the visbroken effluent is characterized by a high viscosity which necessitates blending with cutter stock, and concomitantly this represents a decrease in net distillate production.

Accordingly, it is an object of this invention to provide an improved process for upgrading heavy hydrocarbon oils for use as liquid fuels and as demetalized and desulfurized feedstocks for refinery cracking operations.

It is another object of this invention to provide a catalytic hydrovisbreaking process in which the catalyst exhibits resistance to metals, nitrogen and sulfur and is characterized by long term on-stream stability.

It is a further object of this invention to provide a catalytic process for hydrovisbreaking heavy hydrocarbon oils to increase the yield of distillate products and at the same time produce a residual 1000° F.+ fraction which has a relatively low viscosity that requires little or no cutter stock to meet heavy fuel oil specifications.

Other objects and advantages of the present invention shall become apparent from the accompanying description and examples.

DESCRIPTION OF THE INVENTION

One or more objects of the present invention are accomplished by the provision of a process for enhancing the hydroconversion of a heavy hydrocarbon oil having a Conradson Carbon Residue content between about 8–30 weight percent, which process comprises (1) contacting the heavy hydrocarbon oil with hydrogen and a catalyst in a hydrovisbreaking zone at a temperature between about 650°–850° F. and a pressure between about 200–2000 psi and a liquid hourly space velocity between about 0.1–5, wherein said catalyst comprises (a) a crystalline zeolite component having a silica/alumina ratio greater than about 12, and an acid activity less than about 10 on the Alpha Scale, and (b) a metallic hydrogenation component; and (2) recovering and fractionating the visbroken effluent to provide distillate products and a 1000° F.+ fraction which has a Kinematic Viscosity between about 30,000–60,000 centistokes at 100° F.

For purposes of the present invention, the term "heavy hydrocarbon oil" is meant to include petroleum oil residua and tar sand bitumen feedstocks, in which mixtures at least 75 weight percent of the constituents have a boiling point above about 700° F.

Typically, a heavy hydrocarbon oil suitable for treatment in accordance with the present invention has a metals' content of at least 80 ppm, and a Conradson Carbon Residue content of at least about 8 weight percent.

In a preferred process embodiment, the zeolite component of the catalyst has a Constraint Index between about 1–12, and the exchange sites of the zeolite are occupied substantially by alkali metal cations.

An important aspect of the process is that the zeolite component is characterized by low acidity. By the term "low acidity" is meant an acidic activity which measures less than about 10 on the Alpha Scale, and preferably the measured Alpha value of the zeolite is less than unity.

The measurement of the acid activity of zeolite catalysts as defined by the Alpha Scale is described in Journal of Catalysis, Vol. VI, pages 278–287 (1966).

Another important characteristic of the zeolite component of the catalyst is that it provides constrained access to and egress from the intracrystalline free space. The Constraint Index is calculated by the following ratio:

$$\text{Constraint Index} = \frac{\log_{10}(\text{fraction of n-hexane remaining})}{\log_{10}(\text{fraction of 3-methyl pentane remaining})}$$

The constraint index approximates the ratio of the cracking rate constants for the two hydrocarbons. Preferred zeolites are those having a Constraint Index in the approximate range of 1 to 12. Constraint Index (CI) values for some typical zeolites are as follows:

| ZEOLITE | C.I. |
|---|---|
| ZSM-5 | 8.3 |
| ZSM-11 | 8.7 |
| ZSM-12 | 2 |
| ZSM-38 | 2 |
| ZSM-35 | 4.5 |
| TMA Offretite | 3.7 |
| Beta | 0.6 |
| ZSM-4 | 0.5 |
| H—Zeolon | 0.4 |
| REY | 0.4 |
| Amorphous Silica-Alumina | 0.6 |
| Erionite | 38. |

The preferred type of zeolite component is exemplified by ZSM-5, ZSM-11, ZSM-12, ZSM-35, ZSM-38 and other similar materials. U.S. Pat. No. 3,702,886 describing and claiming ZSM-5 is incorporated herein by reference.

ZSM-11 is more particularly described in U.S. Pat. No. 3,709,979, which is incorporated herein by reference.

ZSM-12 is described in U.S. Pat. No. 3,832,449, which is incorporated herein by reference.

ZSM-35 is described in U.S. Pat. No. 4,016,245, which is incorporated herein by reference.

ZSM-38 is described in U.S. Pat. No. 4,046,859, which is incorporated herein by reference.

In addition to those zeolites, the invention in its broader aspects of zeolites having a silica/alumina ratio above 12 also contemplates such zeolites as Beta, described in U.S. Pat. No. Re. 28,341.

The particularly preferred type of zeolite component is one which has the acid activity and Constraint Index properties described above, and in addition has a crystal framework density (in the dry hydrogen form) of not substantially below 1.6 grams per cubic centimeter. Crystal framework densities of some typical zeolites are as follows:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27. |

With respect to the required low acid activity of the zeolite component, this can be achieved by employing a zeolite of very high silica/alumina ratio or by severe high temperature steaming of zeolites having lower silica/alumina ratio. For example, zeolite ZSM-5 of ratio 40 may be treated with 100% steam at 1200° F. for a period of time (several hours) adequate to reduce the acid activity to the necessary level.

The low acid activity of the zeolite component can also be accomplished by extensive ion exchange of the zeolite with sodium, cesium or other alkali metal cation.

The silica/alumina ratio of the zeolite component is in the range of about 12 to aluminum free, and typically will be in the range between about 20–2000.

When the zeolite component has been exchanged with an alkali metal cation, the alkali metal content will vary between about 0.4–5.2 weight percent. The alkali metal content can be expressed in terms of 0.33–1.5 milliequivalents per gram. A ZSM-5 zeolite containing about 40 ppm of aluminum and about one percent sodium is an excellent zeolite component for purposes of the present invention catalyst.

As noted previously, the present invention catalyst also includes a metallic hydrogenation component as an essential ingredient, e.g., metals of Groups VI and VIII of the Periodic Table. Illustrative of suitable hydrogenation metals are cobalt, molybdenum, nickel, tungsten, and the like.

The said hydrogenation metal can be associated with the zeolite component, either by exchange or by deposition on the zeolite surfaces. Preferably, the hydrogenation metal is provided on a porous refractory support such as alumina. The quantity of hydrogenation metal will vary between about 0.1–40 weight percent, based on the weight of the carrier. In a typical embodiment, a catalyst of the invention process is prepared by compositing an admixture of approximately equal quantities of zeolite component and hydrogenation metal/support component.

In the practice of the present invention hydrovisbreaking process as a refinery scale operation, a heavy hydrocarbon oil is pumped through a heat exchanger to be preheated by exchange against the product of the process. The preheated heavy oil is passed to a furnace where it is heated further to a temperature suitable for the desired conversion. The heated charge is then introduced into a visbreaker unit for hydrovisbreaking in the presence of hydrogen and a present invention low acidity type catalyst.

The following Examples are further illustrative of the present invention. The specific ingredients and processing parameters are presented as being typical, and various modifications can be derived in view of the foregoing disclosure within the scope of the invention.

EXAMPLE I

This Example illustrates thermal visbreaking and catalytic visbreaking processes not in accordance with the practice of the present invention.

A ZnPdZSM-5 catalyst is prepared from a 70/1 $SiO_2$-/$Al_2O_3$ HZSM-5 zeolite containing 0.5 weight percent palladium and 0.1 weight percent of zinc.

The catalytic visbreaking procedure is conducted in a downflow stainless steel reactor at 100 psig and 700°–815° F. and LHSV of 1.0. The thermal visbreaking run is conducted under similar conditions, except that Vycor chips are employed in place of the zeolite catalyst. A heavy Celtic crude is used as the feedstock, the properties of which are shown in Table 1.

The comparative data obtained are summarized in Table 2. The data indicate that catalytic visbreaking is more effective than thermal visbreaking in terms of viscosity reduction. However, the zeolite catalyst is short-lived. After 11 days on stream, the catalytic data are approximately the same as that of the thermal visbreaking method.

TABLE 1

| Properties of Celtic Crude Feedstock | |
|---|---|
| Sulfur, wt % | 3.42 |
| Nitrogen, wt % | 0.28 |
| Carbon, wt % | 81.54 |
| Basic nitrogen, wt % | 0.068 |
| Hydrogen, wt % | 11.05 |
| Nickel, ppm | 42 |
| Vanadium, ppm | 110 |
| Water and Sediment, % | 4.0 |
| Pour Point, °F. | −10 |
| Conradson Carbon Residue, wt % | 9.33 |
| Kinetic Viscosities, cs | |
| at 60° F. | 8339 |
| at 100° F. | 1064 |
| at 130° F. | 332 |
| Density | 0.972 |
| Asphaltenes, wt % | 9.56 |

TABLE 2

| Temp., °F. | LHSV, $hr^{-1}$ | Time on stream, days | % Viscosity reduction at 77° F. |
|---|---|---|---|
| Charge: Celtic crude; catalyst: Zn/Pd/HZSM-5 Pressure: 100 psig | | | |
| 700 | 1.10 | 2 | 81.8 |
| 710 | 1.11 | 4 | 83.5 |
| 724 | 1.14 | 7 | 86.9 |
| 740 | 0.83 | 9 | 85.6 |
| 756 | 1.07 | 11 | 92.6 |
| 770 | 1.13 | 14 | 96.5 |
| 785 | 1.14 | 16 | 97.4 |
| 800 | 1.12 | 18 | 97.8 |
| 815 | 1.10 | 21 | 97.8 |
| Charge: Celtic crude; no catalyst; Vycor Pressure: 100 psig | | | |
| 700 | 0.39 | 2 | 60.6 |
| 701 | 0.93 | 4 | 50.4 |
| 711 | 0.57 | 7 | 68.9 |
| 725 | 0.72 | 9 | 72.6 |
| 740 | 0.67 | 11 | 87.4 |
| 755 | 0.84 | 14 | 92.3 |
| 771 | 0.76 | 16 | 96.3 |
| 790 | 0.41 | 21 | 98.5 |
| 785 | 0.98 | 23 | 95.1 |
| 801 | 1.02 | 25 | 97.5 |

EXAMPLE II

This Example illustrates the preparation of a NaZSM-5 type of catalyst component.

The component is prepared by the addition of 3.0 grams $NH_4ZSM$-5 at room temperature to 150 milliliters of 0.2 N NaCl solution having a pH of 10.0 (pH adjusted with 0.1 N NaOH). The mixture is maintained at room temperature for 48 hours with occasional agitation by swirling to avoid particle breakage. The pH of the solution is monitored frequently and adjusted to 10.0 with 0.1 N NaOH as required.

Before overnight contact, the pH is adjusted to 11.0. After 48 hours the liquid is decanted and replaced with 150 milliliters of fresh NaCl/NaOH solution. The exchange is completed by 53 hours as determined by the constancy of the pH. The catalyst is washed with 150 milliliters of dilute NaOH solution and dried at 130° C.

EXAMPLE III

This Example illustrates the upgrading of Arab Light 650° F.+ residuum with a present invention low acidity NaZSM-5/CoMo/$Al_2O_3$ catalyst in comparison with a prior art acidic Pd/HZSM-5 catalyst.

The NaZSM-5 component is prepared by a procedure similar to that described in Example II. A quantity of $NH_4ZSM$-5(40/1 $SiO_2/Al_2O_3$) is exchanged with NaCl. Equal volumes of NaZSM-5 and CoMo/$Al_2O_3$ are mixed, ground to a fine powder, pelleted, and sized to 10–14 mesh. The CoMo/$Al_2O_3$ component contains CoO:$MoO_3$:$Al_2O_3$ in a weight ratio of 1:36:24.

The Pd/HZSM-5 catalyst is an extrudate of 35 weight percent alumina with 65 weight percent of ZSM-5 of 70 silica/alumina ratio containing 0.5 weight percent of palladium.

The hydrovisbreaking process is conducted in a down-flow stainless steel reactor. The catalysts are presulfided prior to use. The range of reaction conditions are as follows:

| | |
|---|---|
| Pressure, psig | 1250–1280 |
| Temperature, °F. | 700–780 |
| LHSV | 0.2–0.5 |

-continued

| | |
|---|---|
| $H_2$ circ., SCF/BBL | 4000–6000 |

The results of a 26 day continuous run are summarized in Table 3, in comparison with a hydrocracking conversion of the Arab Light residuum over the PD/HZSM-5 catalyst.

The data in Table 3 indicate that the present invention hydrovisbreaking process yields a liquid product which has a higher hydrogen content and a lower sulfur content than does the liquid product derived from the hydrocracking conversion run over Pd/HZSM-5 catalyst. Also, the invention low acidity catalyst is more stable (less ageing) and more active than the acidic PdHZSM-5 catalyst.

Table 4 is a summary of elemental analyses of Table 3 runs. The data indicate that the present invention low acidity NaZSM-5/CoMo/$Al_2O_3$ catalyst exhibits a higher demetalation activity than does the acidic PdHZSM-5 catalyst.

EXAMPLE IV

This Example illustrates a comparison of product distribution from thermal visbreaking of Arab light 650° F.+ residuum and that from the present invention catalytic hydrovisbreaking process when operated in accordance with the Example III conditions.

The comparative data are summarized in Table 5.

A significant difference between the thermal and catalytic visbreaking processes is in boiling range conversion. About 38 percent of the products from catalytic hydrovisbreaking are marketable premium fuel products including naphtha and No. 2 fuel oil. In addition, the 1000° F.+ product viscosity is reduced from 83,000 to 37,000 centistokes in contrast to typical thermal visbreaking results.

The 850° F.+ residue from the invention hydrovisbreaking process has a reduced sulfur concentration, but is more viscous than the specification of 3500 Redwood I, seconds (equivalent to a Kinematic Viscosity of 858 centistokes at 100° F.).

The quantity of 650°–850° F. product required for blending with the 850° F.+ fraction to reduce its viscosity to 3500 Redwood I at 100° F. is calculated for the column 7 (Table 3) product mixture. The following is a nominal product distribution after blending:

| | Wt % |
|---|---|
| Dry gas | 2 |
| LPG | 13 |
| $C_5$–420 | 5 |
| 420–650 | 8 |
| 650–850 | 12 |
| No. 6 Fuel | 60. |

With reference to the Table 5 data, it is evident that thermal visbreaking of a residuum feedstock yields a 1000° F.+ fraction that is characterized by a high viscosity, e.g., a viscosity that is higher than the residuum feedstock.

These results are determined by the chemical nature of the residuum feedstock which is composed of colloidal asphaltene and heavy hydrocarbon oils. The colloidal asphaltene particles are non-volatile and difficult to crack under thermal visbreaking conditions. The heavy hydrocarbon oils are more easily cracked and serve as a solution medium for the asphaltenes. The 1000° F.+ fraction has a high viscosity because it is in effect a concentrated solution of unconverted asphaltenes. The present invention hydrovisbreaking process provides a lower viscosity 1000° F.+ fraction because it converts a portion of the asphaltenes to lower boiling constituents.

EXAMPLE V

This Example illustrates that the present invention process employing a low acidity high silica-alumina ratio zeolite catalyst (with a metallic hydrogenation component) is effective for hydrovisbreaking a 750° F.+ residuum.

Two alkali zeolitic components are prepared by ion-exchanging a 60/1 $SiO_2/Al_2O_3$ HZSM-5 and a 30/1 $SiO_2/Al_2O_3$ Beta zeolite at room temperature with a 1 N aqueous solution of sodium bicarbonate. After the exchange, the catalysts are washed with dilute NaOH solution (pH of about 9) and dried at 130° C. The Alpha value of the resulting respective catalysts is less than 1.

$NiMO/Al_2O_3$ hydrotreating catalyst (HT-500 commercial Harshaw extrudate) is used in combination with NaZSM-5 and Na Beta by physically admixing equal volumes of the two components. The hydrotreating component is presulfided in the reactor by flowing 1% $H_2S$ in $H_2/N_2$ over the mixed catalyst while raising the temperature 50° C. every 30 minutes to 600° F. and holding at that temperature for 2 hours (1 atm pressure).

The upgrading of Arab Light 750° F.+ residuum (properties listed in Table 6) is conducted at 875° F., 500 psig, 2400 SCF/BBL $H_2$ circulation and LHSV=3.5. The results are presented in Table 7. The results indicate that low acidity catalysts with/without hydrotreating components enhance conversion and reduce product viscosity below levels observed in thermal operation with no catalyst. In addition, combination catalysts containing $NiMo/Al_2O_3$ produce a substantial net yield of gasoline and distillate (G&D) along with No. 6 fuel product which satisfies the required viscosity specification.

TABLE 3

| | | Run Balance | | | | | | |
|---|---|---|---|---|---|---|---|---|
| | | 1 | 3 | 5 | 6 | 7 | 8 | Pd/HZSM-5 |
| Time on stream, Days | | 1 | 6 | 11 | 15 | 21 | 26 | 8 |
| Temperature, °F. | | 704 | 722 | 750 | 770 | 770 | 780 | 776 |
| Pressure, psig | | 1250 | 1250 | 1250 | 1250 | 1250 | 1250 | 1250 |
| Space Velocity V/V/hr. | | 0.49 | 0.44 | 0.30 | 0.19 | 0.31 | 0.34 | 0.50 |
| $H_2$ Circ., SCF/BBL | | 4130 | 4143 | 3810 | 6015 | 3686 | 3361 | 5000 |
| Yields, wt. % feed | | | | | | | | |
| $C_1$ | 0 | 0.09 | 0.13 | 0.36 | 0.60 | 0.55 | 0.75 | 0.50 |
| $C_2$ | 0 | 0.34 | 0.29 | 0.59 | 1.02 | 1.09 | 1.51 | 1.20 |
| $C_3$ | 0 | 3.61 | 4.11 | 5.21 | 6.64 | 7.05 | 7.54 | 6.20 |
| $C_4$ | 0 | 3.70 | 4.38 | 4.69 | 5.08 | 6.73 | 4.90 | 5.40 |
| Total $C_4$- | 0 | 7.74 | 8.90 | 10.85 | 13.34 | 15.43 | 14.70 | 13.30 |
| $C_5$-420° F. | 0 | — | 3.50 | 2.00 | 2.60 | 4.50 | 5.00 | 5.90 |
| 420°-800° F. | 28 | 23.00 | 23.00 | 26.00 | 28.00 | 23.00 | 30.00 | 30.00 |
| 800°-1000° F. | 27 | 31.26 | 20.00 | 61.00 | 24.00 | 25.00 | 23.00 | 17.00 |
| 1000° F.+ | 45 | 38.00 | 45.00 | | 32.00 | 32.00 | 27.00 | 34.00 |
| $H_2$ Consumption, SCF/BBL | — | — | — | — | 550 | 300 | 550 | 364 |
| Liquid Analysis, wt. % | | | | | | | | |
| Hydrogen | 11.24 | — | — | — | 11.30 | 11.30 | 11.16 | 10.50 |
| Nitrogen | 0.17 | — | — | — | 0.18 | 0.15 | 0.17 | 0.16 |
| Sulfur | 3.17 | — | — | — | 1.20 | 1.50 | 1.50 | 3.30 |

TABLE 4

| | Feed | Viscosity NaZSM-5/ $CoMo/Al_2O_3$ | | Hydrocracked PdHZSM-5 |
|---|---|---|---|---|
| Reaction Temp., °F. | | 770 | 780 | 776 |
| Analysis, | | | | |
| Nitrogen, % | 0.17 | 0.18 | 0.17 | 0.16 |
| Sulfur, % | 3.17 | 1.2 | 1.5 | 3.35 |
| Nickel, ppm | 11 | 2.3 | 2.5 | 10 |
| Vanadium, ppm | 36 | 1.3 | 2.2 | 28 |
| Liquid Rec., % | — | 87 | 85 | 81.5 |
| Percent Removal | | | | |
| Nitrogen | — | 13 | 15 | 42 |
| Sulfur | — | 67 | 60 | 14 |
| Nickel | — | 80 | 80 | 36 |
| Vanadium | — | 97 | 95 | 37 |
| 450-850°, Pour pt, °F. | | −45 | −30 | −55 |
| 850-1000° F., Kinematic Viscosity @ 100° F., cs | >2000 | 193 | — | — |
| 1000° F.+ Kinematic Viscosity @ 100° F., cs | 83,000 | 37,660 | — | — |

TABLE 5

| | Feed | Thermal | Catalytic |
|---|---|---|---|
| Product Yields, wt. % | | | |
| Dry Gas | — | 0 | 2 |
| LPG | — | 1 | 13 |
| Naphtha ($C_5$-420° F.) | — | 6 | 5 |
| No. 2 Fuel Oil | 28 | 5 | 20* |
| No. 6 Fuel Oil | 72 | 88 | 60 |
| Kinematic Viscosity at 100° F., cs | | | |
| 1000° F.+ | 83,000 | >83,000 | 37,600 |

*End point 850° F.

TABLE 6

| Properties of Arab Light 750° F.+ Resid | |
|---|---|
| API Gravity | 10.2 |
| C (wt. %) | 84.60 |
| H (wt. %) | 10.45 |
| O (wt. %) | 0.00 |
| N (wt. %) | 0.2999 |
| S (wt. %) | 3.88 |
| Ash (wt. %) | 0.01 |
| H/C (atomic) | 1.48 |
| Ni (ppm) | 16 |
| V (ppm) | 58 |

TABLE 6-continued

| | |
|---|---|
| CCR (wt. %) | 14.53 |
| Asphaltenes (wt. %) | 13.0 |
| Ni in asphaltenes (ppm) | 85 |
| V in asphaltenes (ppm) | 305 |
| Ni in deasphalted oil (ppm) | 5 |
| V in deasphalted oil (ppm) | 18 |
| Distillation (wt. %) | |
| 775° F.− | 1.2 |
| 775–1075° F. | 8.6 |
| 1075° F.+ | 90.2 |
| Total Resid Viscosity (cs) | |
| KV* at 40° C. | 43,725 |
| KV at 55° C. | 7,255 |
| KV at 100° C. | 280 |
| 775° F.+ Resid Viscosity (cs) | |
| KV (cs) at 100° C. | ~280 |

*Kinematic Viscosity.

TABLE 7

750° F.+ Residuum Visbreaking
Pressure = 500 psig, Temperature = 875° F.,
$H_2$ circulation = 2400 SCF/BBL, LHSV = 3.5

| | Vycor | NaZSM-5 | NaZSM-5/ HT-500 | Na Beta/ HT-500 |
|---|---|---|---|---|
| Yields, wt. % | | | | |
| Gas | 1 | 2 | 3 | 3 |
| Liquid | 99 | 98 | 97 | 97 |
| Liquid Product KV at 100° F., cs | 1354 | 473 | 110 | 365 |
| Net No. 6 Fuel, wt % feed | 99* | 94 | 84 | 87 |
| Net G&D, wt % feed | — | 4 | 13 | 10 |

*Does not meet specification. Requires addition of cutter stock.

What is claimed is:

1. A process for enhancing the hydroconversion of a heavy hydrocarbon oil having a Conradson Carbon Residue content between about 8–30 weight percent, which process comprises (1) contacting the heavy hydrocarbon oil with hydrogen and a catalyst in a hydrovisbreaking zone at a temperature between about 650°–850° F. and a pressure between about 200–2000 psi and a liquid hourly space velocity between about 0.1–5, wherein said catalyst comprises (a) a crystalline zeolite component having a silica/alumina ratio greater than about 12, and an acid activity less than about 10 on the Alpha Scale, and (b) a metallic hydrogenation component; and (2) recovering and fractionating the visbroken effluent to provide distillate products and a 1000° F.+ fraction which has a Kinematic Viscosity between about 30,000–60,000 centistokes at 100° F.

2. A process in accordance with claim 1 wherein said zeolite has a Constraint Index between about 1–12.

3. A process in accordance with claim 1 wherein the exchange sites of said zeolite are occupied substantially by alkali metal cations.

4. A process in accordance with claim 1 wherein said zeolite is NaZSM-5.

5. A process in accordance with claim 1 wherein said zeolite is NaZSM-12.

6. A process in accordance with claim 1 wherein said zeolite is Na-Beta.

7. A process in accordance with claim 1 wherein said metallic hydrogenation component is cobalt-molybdenum.

8. A process in accordance with claim 1 wherein said metallic hydrogenation component is nickel-tungsten.

9. A process in accordance with claim 1 wherein said metallic hydrogenation component is on a porous refractory support.

10. A process in accordance with claim 1 wherein said metallic hydrogenation component occupies exchange sites of said zeolite component.

* * * * *